US012139877B2

(12) United States Patent
Kollmann

(10) Patent No.: US 12,139,877 B2
(45) Date of Patent: Nov. 12, 2024

(54) ADAPTER FOR A QUICK-CHANGE SYSTEM AND QUICK-CHANGE SYSTEM WITH SUCH AN ADAPTER

(71) Applicant: OilQuick Deutschland KG, Steindorf (DE)

(72) Inventor: Michael Kollmann, Egling an der Paar (DE)

(73) Assignee: OilQuick Deutschland KG, Steindorf (DE)

( * ) Notice: Subject to any disclaimer, the term of this patent is extended or adjusted under 35 U.S.C. 154(b) by 611 days.

(21) Appl. No.: 17/340,268

(22) Filed: Jun. 7, 2021

(65) Prior Publication Data

US 2021/0381192 A1 Dec. 9, 2021

(30) Foreign Application Priority Data

Jun. 8, 2020 (DE) ..... 10 2020 115 197.7

(51) Int. Cl.
*E02F 3/36* (2006.01)

(52) U.S. Cl.
CPC ..... *E02F 3/3622* (2013.01); *E02F 3/3663* (2013.01)

(58) Field of Classification Search
CPC ..... E02F 3/3609; E02F 3/3618; E02F 3/3622; E02F 3/3627; E02F 3/3631; E02F 3/365; E02F 3/3654; E02F 3/3663; E02F 3/369
See application file for complete search history.

(56) References Cited

U.S. PATENT DOCUMENTS

| | | | | |
|---|---|---|---|---|
| 5,890,871 | A * | 4/1999 | Woerman | E02F 3/364 37/468 |
| 6,487,800 | B1 * | 12/2002 | Evans | E02F 3/364 37/468 |
| 7,473,067 | B2 * | 1/2009 | Nishioka | E02F 3/365 37/468 |
| 10,612,208 | B2 * | 4/2020 | Maruyama | E02F 3/3672 |
| 10,934,680 | B2 * | 3/2021 | Lehnhoff | E02F 3/3668 |
| 11,274,414 | B2 * | 3/2022 | Sieber | E02F 3/3622 |
| 11,396,733 | B2 * | 7/2022 | Kollmann | E02F 3/364 |
| 11,441,290 | B2 * | 9/2022 | Thomas | E02F 3/3627 |
| D967,871 | S * | 10/2022 | Schauer | E02F 3/365 D15/28 |
| 11,482,083 | B2 * | 10/2022 | Kollmann | E02F 9/24 |

(Continued)

FOREIGN PATENT DOCUMENTS

| | | | | |
|---|---|---|---|---|
| DE | 102005037105 | B3 * | 11/2006 | E02F 3/3622 |
| DE | 202013001658 | U1 * | 5/2013 | E02F 3/3627 |

(Continued)

OTHER PUBLICATIONS

Result of Examination Report for German Patent Application No. 10 2020 115 197.7 dated Dec. 14, 2020.

*Primary Examiner* — Jonathan P Masinick
(74) *Attorney, Agent, or Firm* — Paul D. Bianco; Katharine Davis Wong; Fleit Intellectual Property Law

(57) ABSTRACT

An adapter for a quick-change system for changing attachments on a construction machine contains coupling elements arranged at a stipulated spacing from each other between two side walls for connection of the adapter to a quick changer. In order to provide improved protection from damage, the rear ends of the two side walls project rearwardly with respect to a back cover arranged between the side walls.

11 Claims, 2 Drawing Sheets

(56) References Cited

U.S. PATENT DOCUMENTS

| | | | | |
|---|---|---|---|---|
| 2006/0242865 | A1* | 11/2006 | Herguido Fo | E02F 3/3636 37/468 |
| 2012/0128404 | A1* | 5/2012 | Sonerud | E02F 9/2228 403/31 |
| 2018/0066418 | A1* | 3/2018 | Keighley | E02F 9/26 |
| 2020/0149243 | A1 | 5/2020 | Schmid | |
| 2022/0106762 | A1* | 4/2022 | Friedrich | E02F 3/3663 |

FOREIGN PATENT DOCUMENTS

| | | | | | |
|---|---|---|---|---|---|
| DE | 10 2012 221 063 | A1 | | 5/2014 | |
| DE | 102015225498 | A1 | * | 6/2017 | |
| DE | 202017107699 | U1 | * | 2/2018 | |
| DE | 202017107700 | U1 | * | 2/2018 | |
| DE | 202018100423 | U1 | * | 3/2018 | E02F 3/3622 |
| DE | 102017110586 | A1 | * | 11/2018 | E02F 3/3622 |
| DE | 102017130436 | A1 | * | 6/2019 | E02F 3/3613 |
| DE | 10 2018 115 249 | A1 | | 1/2020 | |
| DE | 10 2018 128 479 | A1 | | 5/2020 | |
| DE | 10 2019 106 445 | A1 | | 9/2020 | |
| DE | 102019125861 | A1 | * | 3/2021 | E02F 3/3627 |
| DE | 102014019967 | B3 | * | 4/2021 | A61B 34/20 |
| GB | 2 429 197 | A | | 2/2007 | |
| JP | 2010-0159548 | A | | 7/2010 | |
| WO | WO-2004072387 | A1 | * | 8/2004 | E02F 3/3622 |
| WO | WO-2020151876 | A1 | * | 7/2020 | B66C 13/14 |

* cited by examiner

ADAPTER FOR A QUICK-CHANGE SYSTEM AND QUICK-CHANGE SYSTEM WITH SUCH AN ADAPTER

FIELD OF THE DISCLOSURE

The disclosure relates to an adapter for a quick-change system. The disclosure also relates to a quick-change system with such an adapter.

BACKGROUND

Quick-change systems consisting of a quick changer and a corresponding adapter are used for simple and convenient changing of different attachments on construction machines. For example, tilt buckets, grippers, claws, compressors, magnets, hydraulic hammers or other mechanical or hydraulic attachments can be connected to or disconnected from a boom of an excavator from a driver's cab in a few seconds with a high level of safety.

A generic quick-change system is known from DE 10 2018 128 479 A1. It has an adapter with two pin-like coupling elements arranged at a stipulated spacing from each other between parallel side walls for connection of the adapter to a quick changer. The quick changer belonging to the adapter contains claw-like first receptacles on one side for the first pin-like coupling element and second receptacles on the other side with two locking elements movable between an unlocking position and a locking position for releasable holding of the second coupling element. Since the attachments connectable with such a quick-change system generally lie on the ground before connection and must be moved for connection often above non-level or rocky ground, there is a hazard that parts of the adapter or quick changer are then damaged. For example, a protective cover provided on the adapter can be damaged relatively quickly during the changing and mounting of an attachment. Even when large parts of a concrete foundation or a boulder are picked up, especially in a backhoe bucket, the materials are supported against safety catch hooks or other protruding parts of the quick changers, which can lead to safety-related damage.

SUMMARY

One aspect of the disclosure relates to an adapter and a quick-change system with such an adapter that offer improved protection against damage.

Expedient embodiments and advantageous refinements are also disclosed herein.

The two side walls in the adapter according to the disclosure project rearwardly with their rear ends relative to a back cover arranged between the side walls. Even if the attachments provided with such an adapter are positioned so that the rear ends of the side parts of the adapter come in contact with the ground, the back cover is protected by the projecting ends of the side walls. Damage to the back cover can thereby be avoided.

In a particularly expedient embodiment, the rear ends of the side walls also project relative to fastening elements with which the back cover is fastened to a crosspiece arranged between the side walls. The fastening elements are thereby also protected from damage.

The crosspiece arranged between the side walls serves not only to fasten the back cover, but also to ensure improved stability of the adapter. The crosspiece is expediently arranged in form-fitting fashion via end projections in corresponding recesses in the area of the back end of the side walls. Stable connection between the side walls and the crosspiece is thereby made possible.

In a further advantageous embodiment, the rear ends of the side walls have a recessed gradation on their underside. Crack formation during welding and corrosion problems can thereby be avoided.

One or more depressions or recesses can be expediently provided on the outside and/or inside of the side walls. Nameplates, safety warnings or also electronic components, for example, RFID charging systems, tool trackers, NFC chips, electronic transmitters and receivers, data carriers and the like can be accommodated protected from damage in these depressions or recesses. Corresponding depressions to accommodate electronic components can also be provided in the pin-like coupling elements, for example, on their ends. Openings to pass through safety belts, safety chains or other safety devices and flush with each other can also be arranged in the two side walls.

The back cover arranged between the two side walls can have at least one recess with further advantage. Access to the locking mechanism and a hydraulic unit of the adapter can be made possible via this recess. The recess is expediently arranged so that the operator acquires a view of the locking mechanism and can therefore visually check proper locking even in the mounted state. The back cover can be designed so that it is supported with its upper end on the pin-like rear coupling element. The back cover can have recesses or a gap on the bottom so that water or dirt can run off to the outside.

According to further advantageous embodiment, the two side walls protrude with their front ends relative to the front coupling element so that the ratio between the distance A from the front ends to the center of the front coupling element and the diameter D of the front coupling element is at least 1.25. The side parts therefore protrude with their front ends relative to the safety catches in their collapsed positions, and the safety catches are thus protected from damage from concrete slabs, rubble, boulders or other loads.

The disclosure also concerns a quick-change device that includes the adapter described above and a quick changer connectable to it.

BRIEF DESCRIPTION OF THE DRAWINGS

Additional details and advantages of the disclosure are apparent from the following description of a preferred embodiment example with reference to the drawing. In the drawing.

DETAILED DESCRIPTION

Figure 1:
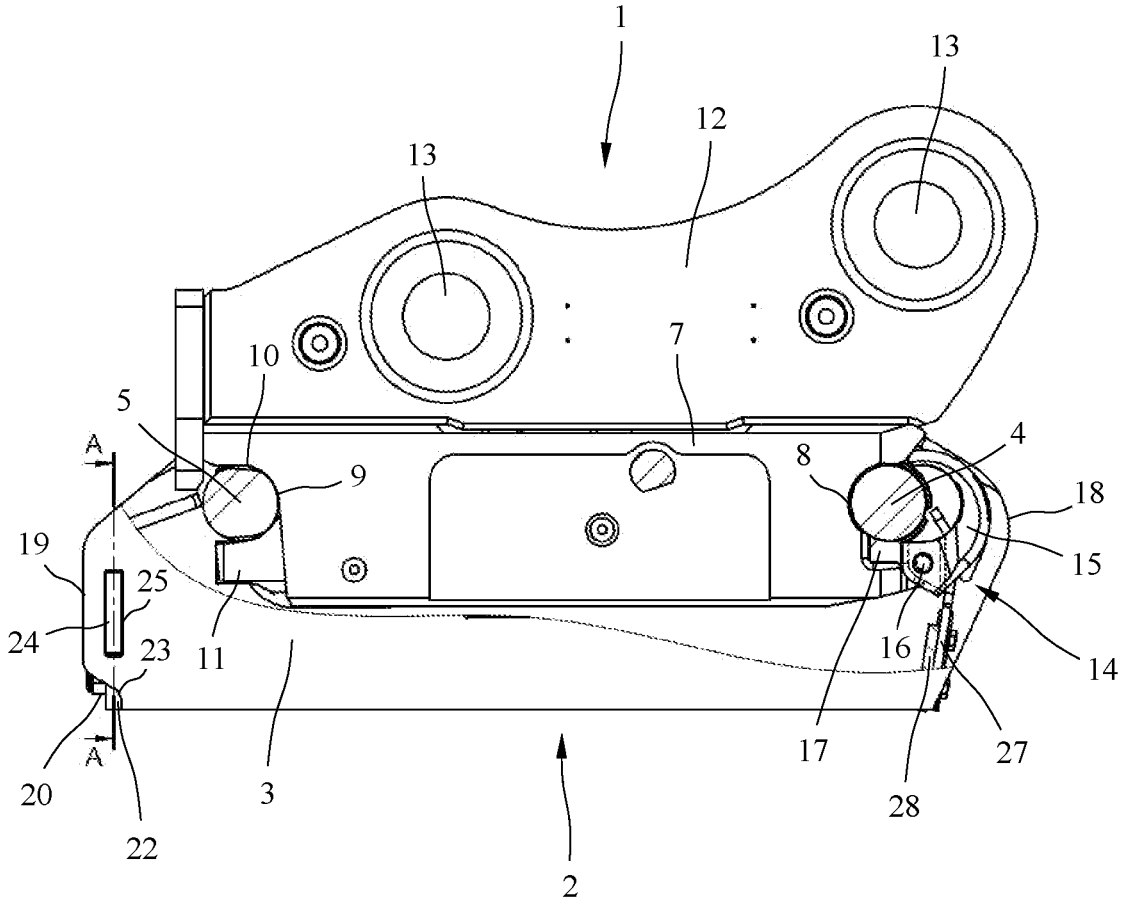
FIG. 1 shows a quick-change system with a quick changer and an adapter in a partly cutaway side view.

An embodiment example of a quick-change system is shown in FIG. 1 with a quick changer 1 mountable on an excavator and an adapter 2 fastenable to an attachment for simple and convenient changing of different attachments on construction machines, especially excavators, in a partially cutaway side view. Tilt buckets, grippers, claws, magnets, compactors, hydraulic hammers or other mechanical or hydraulic attachments can be connected to or disconnected from an excavator arm or other attachment of an excavator or other construction vehicle simply and conveniently from a driver's cab with such a quick-change system.

Figure 2:
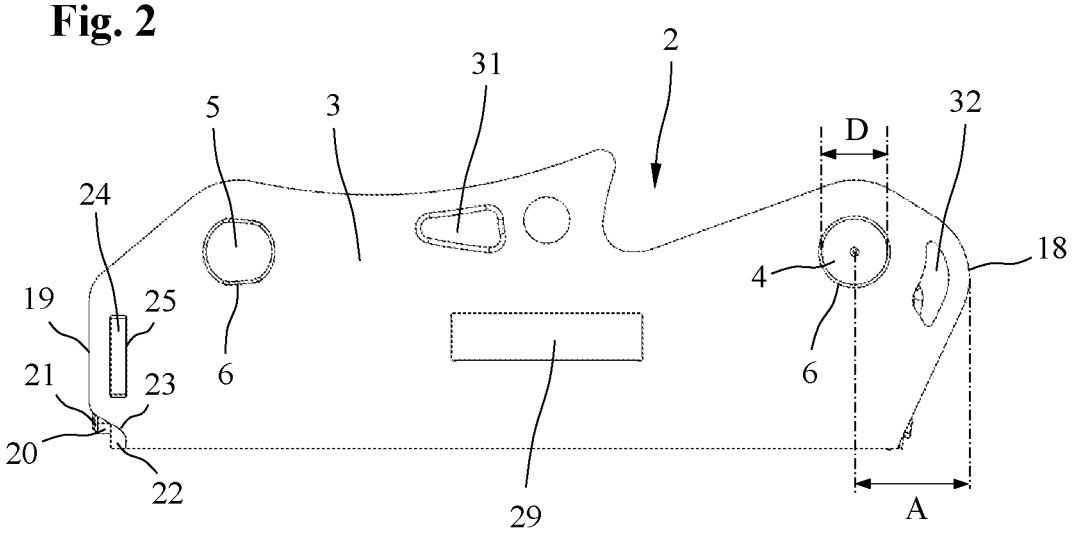
FIG. 2 shows an adapter of a quick-change system depicted in FIG. 1 in a side view.
Figure 3:
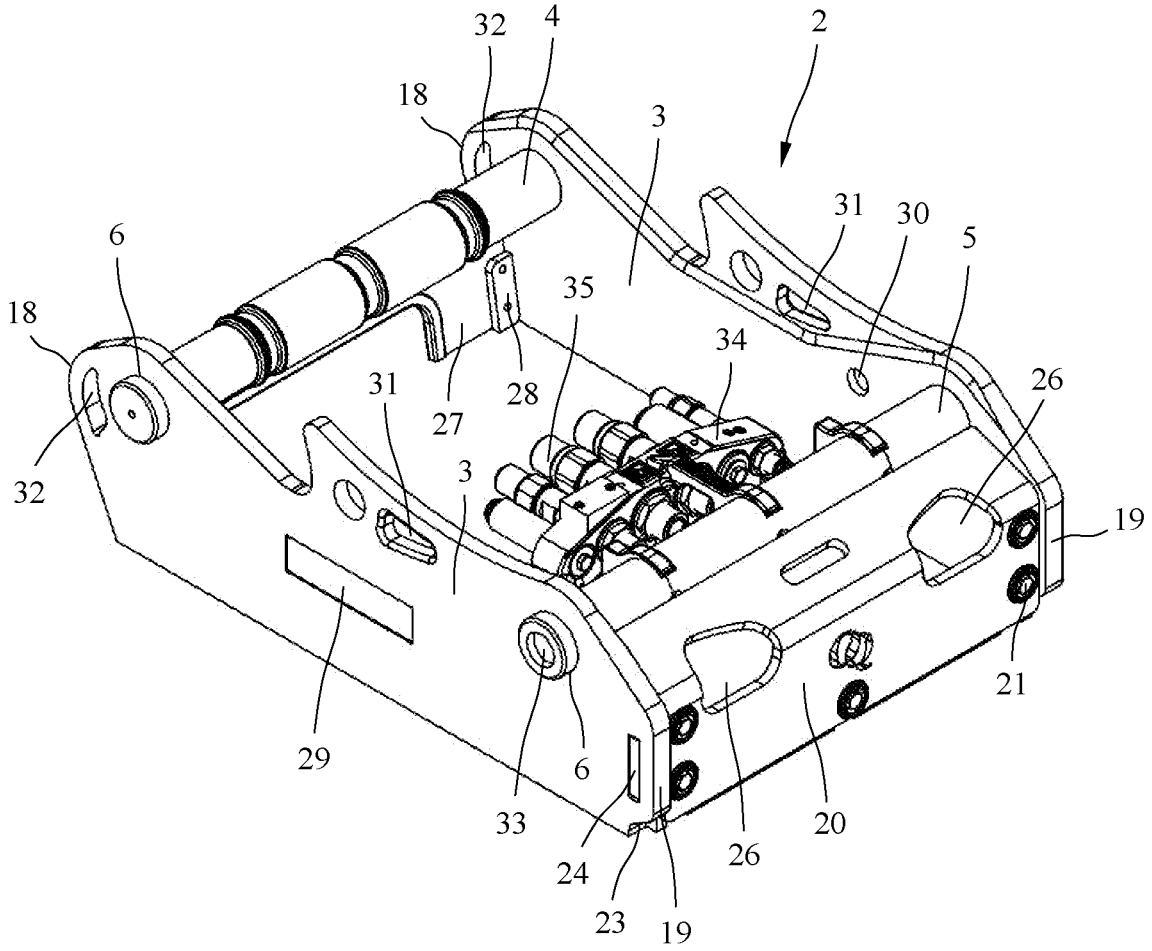
FIG. 3 shows an adapter of a quick-change system depicted in FIG. 1 in a perspective view and FIG. 4 shows a sectional view along line A-A of FIG. 1.

The adapter 2, fastenable to an attachment and depicted separately in FIGS. 2 and 3, contains two parallel side walls 3, between which a front pin-like coupling element 4 and a rear pin-like coupling element 5 spaced from it at a stipulated distance are arranged for releasable connection to quick changer 1. The two pin-like coupling elements 4 and 5 can be inserted into corresponding openings 6 in side walls 4 and fixed there.

The quick changer 1 depicted in a partial section in FIG. 3 also contains a support 7 designed as a welded structure or cast part having first receptacles 8 open to one side to accommodate and hold front pin-like coupling element 4 on one side and receptacles 9 open downward to the other side to accommodate and hold rear pin-like coupling element 5 on the other side.

In the depicted embodiment example, the quick changer 1 contains two receptacles 8 spaced apart from each other on one side of the support 7 for the front coupling element 4 and two receptacles 9 on the other side for the rear coupling element 5. The first receptacles 8 open to one side are designed claw-like or fork-like. The second receptacles 9 open downward to the other side of a curved lower support surface 10 to support the second pin-like coupling element 6. A locking device is provided on the second receptacles 9 with two pin-like locking elements 11 movable between an extended locking position and a retracted unlocking position. The two pin-like locking elements 11 are guided movable within support 7 and are movable by a cylinder between a retracted unlocking position for release or connection of the adapter 2 or an attachment and an extended locking position shown in FIG. 1. In the extended locking position, the second receptacles 9 open downward are closed by the locking elements 11 arranged movable in the guide holes in support 7 on the bottom, so that the second pin-like coupling element 5 is engaged from below by the pin-like locking elements 11.

The support 7 contains two parallel side parts 12 on its top, in which through-holes 13 for fastening pins (not shown) are provided for fastening of the quick changer 1 to an excavator arm or a coupling of an excavator or a connection part of another construction vehicle.

In order to connect an attachment by means of quick changer 1, the quick changer 1, generally arranged on an excavator arm and a coupling of an excavator, is initially moved so that the front coupling element 4, arranged on the adapter 2 or directly on the attachment, is retracted into the claw-like or fork-like receptacles 8 on one side of the quick changer 1. The quick changer 1 is then pivoted about the front pin-like coupling element 4 with the locking elements 11 still retracted, so that the rear coupling element 5 on the adapter or attachment comes in contact with the support surfaces 10 of the downward open receptacles 9 on the other side of the quick changer 1. The locking elements 11 arranged movable in guide holes in support 7 of quick changer 1 can then be extended hydraulically, so that the rear pin-like coupling element 5 is engaged from below by the two locking elements 11 on the quick changer 1 and the attachment is therefore secured on the quick changer 1.

In order to prevent an attachment connected to the quick changer 1 from loosening from the quick changer 1 during an unintended loosening movement of the locking element 11 caused by incorrect operation or disturbances and then from falling down in a raised position of the quick changer, an additional catch device 14 is provided on support 2. The catch device 14 is conceived to grip the coupling element 4 arranged on the adapter 2 or attachment and engage with the first receptacles 8. The catch device 14 is designed so that an attachment is trapped in a catch position and held on the quick changer during unintended loosening from the coupling position by engagement of the coupling element 4.

In the depicted embodiment, the catch device 14 includes two separate safety catches 15 that are not arranged rigidly on the support 2 of the quick changer 1 but are coupled on support 1 pivotable about a transverse axis 16 via a type of hinge. The two safety catches 15 are arranged on the two rear receptacles 8 and designed so that they grasp the front coupling element 4 and the adapter 2 or an attachment and can trap the attachment in a catch position during unintended loosening of the quick changer 1 by engagement of the coupling element 4 on the safety catches 15. Because of the pivotable arrangement, the safety catches 15 can move between a disengaged receiving position and an engaged collapsed position depicted in FIG. 1.

It is also apparent from FIG. 1 that a control element 17 designed for activation by the first coupling element 4 is provided on the safety catch 15. The safety catch 15 can be moved via the control element 17 by the coupling element 4 during engagement in the receptacle 8 from a disengaged receiving position into the collapsed position depicted in FIG. 1. The control element 17 also makes sure that the safety catch 15 can only be moved into a disengaged position that permits a change process if the coupling element 4 is correctly positioned in the safety catch 15. In the depicted embodiment the control element 17 is a projection protruding in the direction of the first receptacle 8 with an upper control surface that is flush with the inside contour of the receptacle 8 in the collapsed position of this safety catch 15 and protrudes inward relative to the inside contour of the receptacle 8 in the disengaged position of the safety catch 15.

The safety catch 15 is designed so that it encloses the coupling element 4 semi-circularly by about 180°. Particularly secure holding in any position of the quick changer 1 can thereby be achieved. The receptacle 8 is then fully enclosed rearwardly by the safety catch 15 in the collapsed position of the safety catch 15.

The catch device 14 just described represents an additional safety device through which an attachment can be reliably secured and held even during unintended release of locking. The catch device 14 is independent of the locking device 11 and not connected to it.

As follows from FIG. 1, the two side walls 3 of the adapter 2 are designed so that the front end 18 of the side walls 3 facing the excavator projects in the area of the front coupling element 4 beyond the safety catch 15 in the collapsed position and the rear end 19 of the side walls 3 facing away from the excavator protrudes in the region of the rear coupling element 5 above a protective cover 20 also shown in FIG. 3. The protective cover 20, consisting of a bent sheet, is fastened via screws or other fastening elements 21 to a crosspiece 22 arranged between the two side walls 3. The side walls 3 have a back-set gradation 23 on the bottom of their rear ends 19. Improved welding is thereby attainable.

It is apparent from FIG. 2 that the front ends 18 of the side parts 3 project relative to the front coupling element 4 so that the ratio A/D between the distance A from the front ends 18 to the center of the front coupling element 4 and the diameter D of the front coupling element 4 is at least 1.25. The side parts 3 therefore project with their front end 18 relative to the safety catch 15 in the collapsed position and the safety catches 15 are thus protected from damage by concrete slabs, rubble, boulders or other loads.

Figure 4:
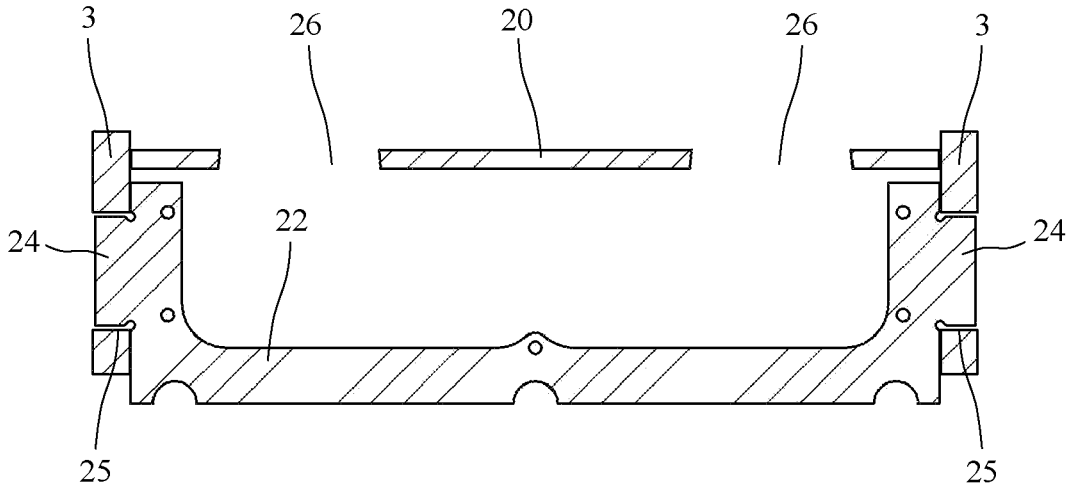

The crosspiece 22 depicted in section in FIG. 4 is arranged in a form-fit manner via end projections 24 and corresponding recesses 25 of side walls 3. Stresses on the welds of the pin-like coupling element 5 can thereby be avoided and parallelism of the side part 3 ensured. As follows from FIG. 3, two recesses 26 arranged next to each other are provided in the protective cover 20. Visual checking of the two locking elements 11 is made possible even when the adapter 2 is connected via the two recesses 26, so that correct locking can be visually checked even from the driver's cab of an excavator. A cover 27 is also provided in the area of the front ends 18 between the two side walls 3. This is screwed onto two holders 28 on the inside of the two side walls 3.

A recess 29 to accommodate an identification mark in the form of a nameplate, a trademark emblem, a safety marking or the like is provided on the outside of side wall 3 of adapter 2. The marking is protected from damage in this recess 29. A recess 30 is also provided on the inside of side wall 3. Electronic components, for example, RFID charging systems, tool trackers, NFC chips, electronic transmitters and receivers, data carriers and the like can also be incorporated in this recess 30 or similar recesses. Even if the adapter 2 comes in contact with the ground with its side wall 3 during transport, the markings in recesses and depressions 29 or recesses 30 necessary for any safety instructions remain protected. Flush passages 31 are also arranged in the upper area of side walls 3. Safety belts, safety chains or other safety elements for transport or transport safety can be guided through these passages 31. An additional opening 32 is provided between the passage 6 for the coupling element 4 and the front end 18 in the side parts 3. Impacts acting on the front ends 18 of the side walls 3 can be cushioned via the openings 32 and the formation of burrs and sharp edges avoided. The hazard of cutting injuries can thereby be minimized. A recess 33 is arranged on the front of the pin-like coupling element.

As follows from FIG. 3, a mount 34 provided with through openings for pin- or sleeve-like coupling elements 35 is fastened to the pin-like coupling element of adapter 2. A connection with corresponding counter elements on the quick changer 1 can occur via these coupling elements 35 during connection of the quick changer 1.

LIST OF REFERENCE NUMBERS

1 Quick changer
2 Adapter
3 Side wall
4 First coupling element
5 Second coupling element
6 Passage
7 Support
8 First receptacle
9 Second receptacle
10 Support surface
11 Locking element
12 Side part
13 Opening
14 Catch device
15 Safety catch
16 Transverse axis
17 Control element
18 Front end
19 Rear end
20 Protective cover
21 Fastening element
22 Crosspiece
23 Gradation
24 Projection
25 Recess
26 Recess
27 Cover
28 Holder
29 Depression
30 Recess
31 Passage
32 Opening
33 Depression
34 Mount
35 Coupling element

What is claimed is:

1. An adapter for a quick-change system for changing attachments on a construction machine, the adapter comprising coupling elements arranged at a stipulated spacing from each other between two side walls for connection of the adapter to a quick changer, wherein the two side walls project rearwardly with their rear ends relative to a back cover arranged between the side walls, wherein the coupling element comprises a front coupling element and a rear coupling element and, wherein the side walls have at least one opening between their front ends and the front coupling element.

2. The adapter according to claim 1, wherein the rear ends of the side walls project opposite fastening elements with which the back cover is fastened to a crosspiece arranged between the side walls.

3. The adapter according to claim 1, wherein a crosspiece is arranged in a form-fit manner in corresponding recesses in the area of the rear ends of side walls via end projections.

4. The adapter according to claim 1, wherein the rear ends of the side walls have a recessed gradation on their underside.

5. The adapter according to claim 1, wherein one or more depressions and/or recesses are provided on the outside and/or inside of the side walls to accommodate identification marks or electronic components.

6. The adapter according to claim 1, wherein a recess is provided in at least one of the coupling elements to accommodate identification marks or electronic components.

7. The adapter according to claim 1, wherein openings flush with each other are arranged in both side walls for passing through safety devices.

8. The adapter according to claim 1, wherein at least one recess is provided in the back cover.

9. The adapter according to claim 1, wherein a ratio between the distance of the front ends to the center of the front coupling element and the diameter of the front coupling is at least 1.25.

10. A quick-change system comprising the adapter according to claim 1 and a quick changer, wherein the adapter is connectable to the quick changer.

11. The quick-change system according to claim 10, wherein the two side walls of the adapter project with their front ends relative to the front coupling element so that the two side walls protrude relative to safety catches arranged on the quick changer in a collapsed position.

* * * * *